US008935158B2

(12) United States Patent
Kim

(10) Patent No.: US 8,935,158 B2
(45) Date of Patent: Jan. 13, 2015

(54) APPARATUS AND METHOD FOR COMPARING FRAMES USING SPECTRAL INFORMATION OF AUDIO SIGNAL

(75) Inventor: Hyun-Soo Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 162 days.

(21) Appl. No.: 13/558,606

(22) Filed: Jul. 26, 2012

(65) Prior Publication Data

US 2012/0290112 A1 Nov. 15, 2012

Related U.S. Application Data

(63) Continuation-in-part of application No. 11/955,483, filed on Dec. 13, 2007, now Pat. No. 8,249,863.

(30) Foreign Application Priority Data

Dec. 13, 2006 (KR) ..... 10-2006-0127120

(51) Int. Cl.

| | |
|---|---|
| ***G10L 19/00*** | (2013.01) |
| ***G10L 21/00*** | (2013.01) |
| ***G10L 25/00*** | (2013.01) |
| ***G10L 25/48*** | (2013.01) |
| *G10L 25/90* | (2013.01) |

(52) U.S. Cl.
CPC *G10L 25/48* (2013.01); *G10L 25/90* (2013.01)
USPC ..... 704/219; 704/201; 704/200

(58) Field of Classification Search
USPC ..... 704/200–230, 500–504
See application file for complete search history.

(56) References Cited

U.S. PATENT DOCUMENTS

| | | | | |
|---|---|---|---|---|
| 4,850,022 | A | 7/1989 | Honda et al. | |
| 4,985,923 | A | 1/1991 | Ichikawa et al. | |
| 5,572,593 | A * | 11/1996 | Nejime et al. | 381/312 |
| 5,583,969 | A * | 12/1996 | Yoshizumi et al. | 704/254 |
| 5,630,011 | A | 5/1997 | Lim et al. | |
| 5,684,920 | A | 11/1997 | Iwakami et al. | |
| 5,873,059 | A | 2/1999 | Iijima et al. | |
| 5,903,655 | A * | 5/1999 | Salmi et al. | 381/321 |
| 5,909,663 | A | 6/1999 | Iijima et al. | |
| 5,956,671 | A | 9/1999 | Ittycheriah et al. | |

(Continued)

FOREIGN PATENT DOCUMENTS

| | | | |
|---|---|---|---|
| JP | 06-149296 | A | 5/1994 |
| KR | 10-2005-0003814 | A | 1/2005 |
| KR | 10-2007-0007684 | A | 1/2007 |
| WO | 01/80223 | A1 | 10/2001 |

*Primary Examiner* — Jesse Pullias
(74) *Attorney, Agent, or Firm* — Cha & Reiter, LLC

(57) ABSTRACT

Disclosed is a frame comparison apparatus and method for comparing frames included in an audio signal by using spectrum information. The frame comparison apparatus includes a spectrum information estimation apparatus for receiving an audio signal and estimating and outputting spectrum information for the respective frames included in the audio signal, an estimation operation option determiner for determining an estimation order of the spectrum information estimated from the spectrum information estimation apparatus, a frame comparison option determiner for determining a comparison order for the frames output from the spectrum information estimation apparatus, and a frame comparator for determining a comparison target frame which is a comparison target for a current frame included in the audio signal, comparing the spectrum information for the current frame with the spectrum information for the comparison target frame, and outputting a comparison result value.

15 Claims, 14 Drawing Sheets

(56) References Cited

U.S. PATENT DOCUMENTS

| | | | | |
|---|---|---|---|---|
| 5,999,897 | A | 12/1999 | Yeldener | |
| 6,064,913 | A * | 5/2000 | Irlicht et al. | 607/57 |
| 6,161,089 | A | 12/2000 | Hardwick | |
| 6,205,422 | B1 | 3/2001 | Gu et al. | |
| 6,401,062 | B1 | 6/2002 | Murashima | |
| 6,681,202 | B1 | 1/2004 | Miet et al. | |
| 6,694,292 | B2 | 2/2004 | Murashima | |
| 7,359,522 | B2 | 4/2008 | Aarts et al. | |
| 2004/0002856 | A1 * | 1/2004 | Bhaskar et al. | 704/219 |
| 2004/0260540 | A1 | 12/2004 | Zhang | |
| 2005/0286743 | A1 | 12/2005 | Kurzweil et al. | |

* cited by examiner

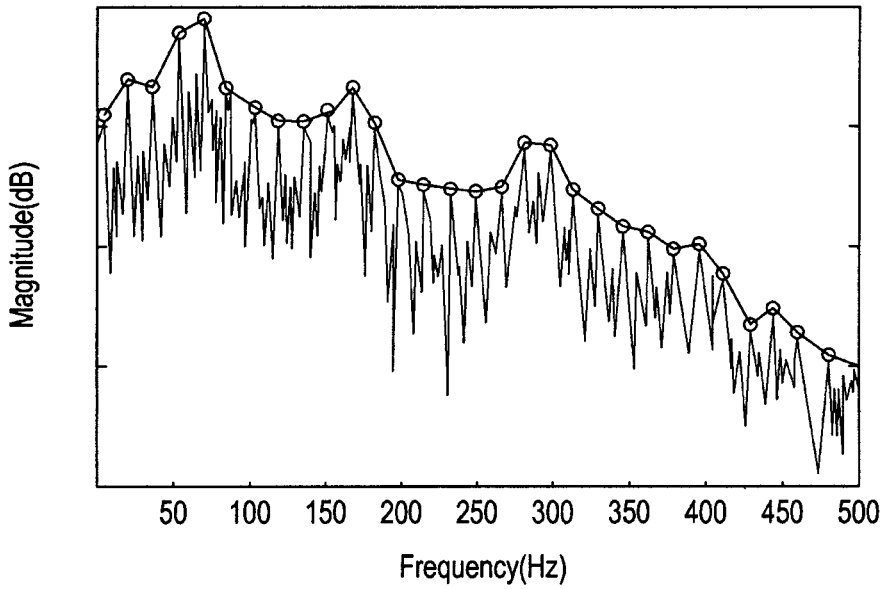
FIG.9
FIG.10A
FIG.10B
FIG.10C
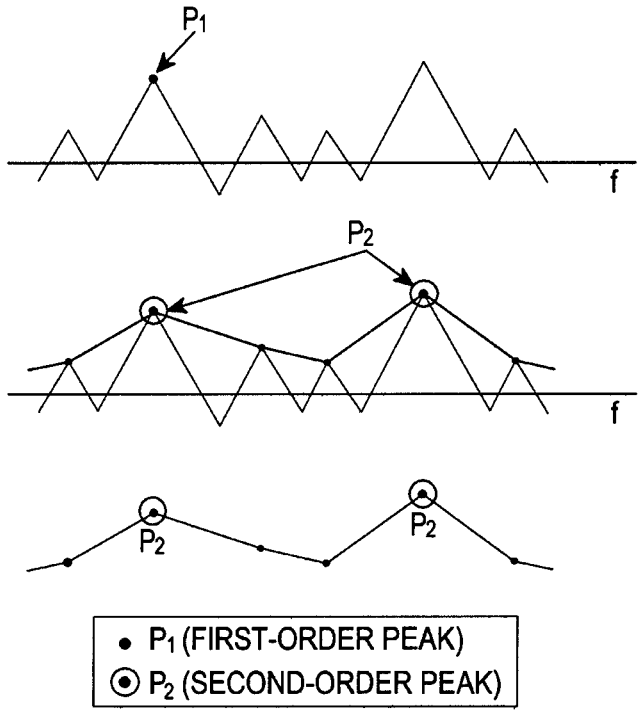

APPARATUS AND METHOD FOR COMPARING FRAMES USING SPECTRAL INFORMATION OF AUDIO SIGNAL

CROSS-REFERENCE TO RELATED APPLICATIONS

This application is a continuation-in-part of U.S. patent application Ser. No. 11/955,483, which was filed in the U.S. Patent and Trademark Office on Dec. 13, 2007, and claims the benefit under 35 U.S.C. §119(a) of an application entitled "Method and Apparatus for Estimating Spectral information of Audio Signal" filed in the Korean Industrial Property Office on Dec. 13, 2006 and assigned Serial No. 2006-0127120, the contents of which are hereby incorporated by reference.

BACKGROUND OF THE INVENTION

1. Field of the Invention

The present invention relates to an apparatus and method for comparing frames included in an audio signal by using spectral information of the audio signal.

2. Description of the Related Art

In conventional technology, there is a problem in that there is no apparatus or algorithm for automatically estimating spectral information of an audio or sound signal in a mobile communication system, and so on.

Meanwhile, according to a conventional method for selecting an order of a high-order peaks spectrum, since the ratio of the total energy of an $N^{th}$ (wherein, N is a natural number) order peaks spectrum to energy of the N largest peaks does not take the energy values of small peaks into consideration, information of an audio signal is lost.

SUMMARY OF THE INVENTION

Accordingly, the present invention has been made to solve the above-mentioned problems occurring in the prior art, and the present invention provides an enhanced apparatus and method for estimating spectrum information of an audio signal by using a morphological operation. Such an apparatus and a method are suitable for processing and transmitting audio and sound signals through a mobile communication terminal.

Specifically, the present invention provides a peak extraction method of extracting information of remainder signal characteristic points by using a structuring set size (SSS), a method of selecting an order of a high-order peak, a method of identifying whether or not a spectrum of an audio signal corresponds to a true peaks spectrum by using pitch information, and a method of changing the SSS according to a result of the identification.

Particularly, the peak extraction method includes a hitting peak method, a mid-point method and a pitch-based method, and an enhanced algorithm for the step of selecting an order of a high-order peak is provided. In addition, the present invention provides an automatic algorithm for setting the most suitable SSS.

The present invention compares frames included in an input audio signal to sort a frame having the largest variation from the audio signal, thereby easily finding out a portion corresponding to the highlight of the audio signal.

The present invention may also provide a frame comparator capable of dividing an audio signal into several frames to classify the audio signal as a plurality of segments, extracting characteristic information for each of the classified segments, and comparing the extracted characteristic information.

In accordance with a first aspect of the present invention, there is provided an apparatus for estimating spectrum information of an audio signal, the apparatus including: an audio signal input unit for receiving an audio signal; a pitch detector for detecting a pitch of the audio signal received through the audio signal input unit and providing the pitch to a structuring set size (SSS) determiner; a morphology filter for performing a morphological operation on the audio signal; a pitch detector for determining a period of the pitch as an SSS of the morphology filter and providing the SSS to the morphology filter; a remainder signal extractor for extracting peaks from the audio signal, which has been subjected to the morphological operation, by using a peak extraction method, extracting a remainder signal region from the extracted peaks, and identifying whether the remainder signal region corresponds to a true peaks spectrum; and a spectral envelope detector for detecting a spectral envelope by performing an interpolation operation on the identified true peaks spectrum.

In accordance with a second aspect of the present invention, there is provided an apparatus for estimating spectrum information of an audio signal, the apparatus including: an audio signal input unit for receiving an audio signal; a pitch detector for detecting a pitch of the audio signal received through the audio signal input unit and providing the pitch to a structuring set size (SSS) determiner; a morphology filter for performing a morphological operation on the audio signal; a pitch detector for determining a period of the pitch as an SSS of the morphology filter and providing the SSS to the morphology filter; a high-order peak selector for extracting peaks from the audio signal, which has been subjected to the morphological operation, by using a peak extraction method, extracting a remainder signal region from the extracted peaks, selecting a high-order peaks spectrum from the remainder signal region, and identifying whether the high-order peaks spectrum corresponds to a true peaks spectrum; and a spectral envelope detector for detecting a spectral envelope by performing an interpolation operation on the identified true peaks spectrum.

In accordance with a third aspect of the present invention, there is provided a method for estimating spectrum information of an audio signal, using the apparatus for estimating spectrum information of the audio signal based on the first aspect of the present invention, the method including the steps of: receiving an audio signal; detecting a pitch of the audio signal; determining a period of the pitch as a structuring set size (SSS) of a morphology filter; performing a morphological operation based on the SSS with respect to the audio signal; extracting peaks from the audio signal, which has been subjected to the morphological operation, by using a peak extraction method, and extracting a remainder signal region from the extracted peaks; identifying whether the remainder signal region corresponds to a true peaks spectrum; and detecting a spectral envelope by performing an interpolation operation on the identified true peaks spectrum.

In accordance with a fourth aspect of the present invention, there is provided a method for estimating spectrum information of an audio signal, using an apparatus for estimating spectrum information of the audio signal based on the second aspect of the present invention, the method including the steps of: receiving an audio signal; detecting a pitch of the audio signal; determining a period of the pitch as a structuring set size (SSS) of a morphology filter; performing a morphological operation based on the SSS with respect to the audio signal; extracting peaks from the audio signal, which has been subjected to the morphological operation, by using a peak extraction method, and extracting a remainder signal region from the extracted peaks; selecting a high-order peaks spectrum from the remainder signal region; identifying whether the high-order peaks spectrum corresponds to a true peaks spectrum; and detecting spectral envelope information by performing an interpolation operation on the identified true peaks spectrum.

A frame comparison apparatus for comparing frames included in an audio signal according to an embodiment of the present invention includes a spectrum information estimation apparatus for receiving an audio signal and estimating and outputting spectrum information for the respective frames included in the audio signal, an estimation operation option determiner for determining an estimation order of the spectrum information estimated from the spectrum information estimation apparatus, a frame comparison option determiner for determining a comparison order for the frames output from the spectrum information estimation apparatus, and a frame comparator for determining a comparison target frame which is a comparison target for a current frame included in the audio signal, comparing the spectrum information for the current frame with the spectrum information for the comparison target frame, and outputting a comparison result value.

A frame comparison method of a frame comparison apparatus for comparing frames included in an audio signal by using spectrum information according to an embodiment of the present invention includes determining an estimation order of spectrum information estimated for an input audio signal, receiving the audio signal and estimating and outputting the spectrum information for the respective frames included in the audio signal based on the estimation order, determining a comparison order for the frames included in the audio signal, determining a comparison target frame which is a comparison target for a current frame included in the audio signal, and comparing the spectrum information for the current frame with the spectrum information for the comparison target frame, and outputting a comparison result value.

BRIEF DESCRIPTION OF THE DRAWINGS

The above and other aspects, features and advantages of the present invention will be more apparent from the following detailed description taken in conjunction with the accompanying drawings, in which:

FIG. 9 is a view illustrating an example in which an interpolation operation has been performed on a remainder signal region by applying a pitch-based method according to an exemplary embodiment of the present invention;

FIGS. 10A to 10C are views illustrating a process of defining high-order peaks according to an exemplary embodiment of the present invention;

DETAILED DESCRIPTION OF THE EXEMPLARY EMBODIMENT

Figure 1:
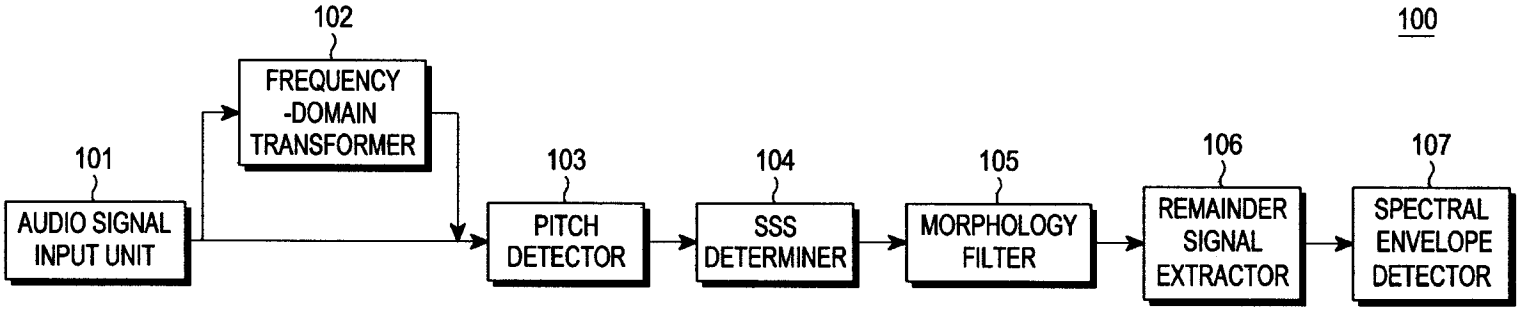
FIG. 1 is a block diagram illustrating the configuration of an apparatus for estimating spectral information of an audio signal according to an exemplary embodiment of the present invention.

Hereinafter, exemplary embodiments of the present invention will be described with reference to the accompanying drawings. The same reference numerals are used to denote the same structural elements throughout the drawings. In the following description of the present invention, the detailed description of known functions and configurations incorporated herein is omitted to avoid making the subject matter of the present invention unclear.

FIG. 1 is a block diagram illustrating the configuration of an apparatus for estimating spectral information of an audio signal according to an exemplary embodiment of the present invention. The audio signal spectrum information estimation apparatus 100 according to an exemplary embodiment of the present invention includes an audio signal input unit 101, a frequency-domain transformer 102, a pitch detector 103, a structuring set size (SSS) determiner 104, a morphology filter 105, a remainder signal extractor 106 and a spectral envelope detector 107.

The audio signal input unit 101 may includes a microphone, etc., and receives an audio signal. The frequency-domain transformer 102 transforms the received audio signal, i.e. the audio signal in a time domain, into an audio signal in a frequency domain. That is, the frequency-domain transformer 102 transforms an audio signal in a time domain into an audio signal in a frequency domain by using a Fast Fourier Transform (FFT). Such a frequency-domain transformer 102 may be selectively included in the audio signal spectrum information estimation apparatus.

Meanwhile, such an audio signal may be processed frame by frame.

The morphology filter 105 performs a morphological operation with respect to the waveform of an audio signal in the frequency domain. The morphological operation is a non-linear image processing and analysis method focusing on the geometric structure of an image. Such a morphological operation may be performed by a plurality of linear and non-linear operators, in which the primary operations of dilation and erosion operations and the secondary operations of opening and closing operations are combined.

The morphology filter 105 according to an exemplary embodiment of the present invention performs the dilation, erosion, opening and closing operations with respect to the waveform of a one-dimensional audio signal in the frequency domain, and partially transforms the geometric characteristics of the audio signal waveform.

Since the morphological operation corresponds to a set-theoretical approach method depending on the fitting of the structuring elements to certain specific values, a one-dimensional image-structuring element, such as an audio signal waveform, is represented by a set of discrete values. Here, the structuring set is determined by a sliding window symmetrical to the origin, and the size of the sliding window determines the performance of the morphological operation.

According to an exemplary embodiment of the present invention, the size of the window is defined by the following Equation (1).

$$\text{Window size}=(\text{structuring set size (SSS)}\times 2+1) \quad (1)$$

As described in Equation (1) above, the size of the window depends on the SSS. Accordingly, it is possible to control the performance of the morphological operation by adjusting the SSS.

The dilation operation is an operation for determining the maximum value within each predetermined sliding window of an audio signal to a value of the corresponding sliding window. The erosion operation is an operation for determining the minimum value within each predetermined sliding window of an audio signal image to a value of the corresponding sliding window. The opening operation is an operation of performing the dilation operation after the erosion operation, and generates a smoothing effect. The closing operation is an operation of performing the erosion operation after the dilation operation, and generates a filling effect.

The morphology filter 105 can perform the dilation or erosion operation and the opening or closing operation. In the case of the dilation operation, a corresponding sliding window frame is referred to as a dilated region. Also, in the case of the erosion operation, a corresponding sliding window frame is referred to as an eroded region.

The morphology filter 105 outputs a discrete signal waveform in which the dilated or eroded region is discretely shown, resulting from the performing of the dilation or erosion operation and the opening or closing operation.

The SSS determiner 104 determines an SSS for optimizing the performance of the morphology filter 105. The SSS may be determined according to each frame of an audio signal. In a first frame of an audio signal, a pitch period of the audio signal is determined as an initial SSS. Such a pitch of the audio signal is detected by the pitch detector 103 and provided to the SSS determiner 104. In frames subsequent to the first frame of the audio signal, an SSS of a just preceding frame of each frame is determined as an initial SSS for the corresponding frame.

Meanwhile, the SSS determiner 104 changes an initial SSS in order to determine an optimal SSS for the morphology filter 105, if necessary.

The remainder signal extractor 106 extracts a remainder signal characteristic point of each frame from the discrete signal waveform which has been received from the morphology filter 105. According to an exemplary embodiment of the present invention, the remainder signal extractor 106 extracts peaks by using peak extraction methods, such as a hitting peak method, a mid-point method, a pitch-based method, and the like, and extracts a remainder signal region from the extracted peaks.

The hitting peak method is a method for extracting the meeting point of each peak and a dilated region or eroded region, as a peak. The mid-point method is a method for extracting the midpoint of each dilated region or eroded region, as a peak. The pitch-based method is a method for extracting actual peaks which cause dilation or erosion irrespective of sliding window frames. Since aforementioned peak extraction methods use the fact that the extracted peaks have higher levels than noises, there is a low probability of extracting noise peaks.

Meanwhile, the remainder signal extractor 106 extracts a remainder signal region from the extracted peaks. Here, the remainder signal region represents a region excluding staircase signal portions from peaks that are extracted from an audio signal (closure floor) having been subjected to the closing operation of the morphological operation, by using one method of the aforementioned peak extraction methods.

Meanwhile, the remainder signal extractor 106 identifies whether or not the extracted remainder signal region corresponds to a true peaks spectrum. The true peaks spectrum does not simply represent a remainder signal region, but rather, it represents a remainder signal region finally identified for detecting a spectral envelope. Since the true peaks spectrum is the final spectrum, which has been obtained through a remainder signal region extraction using various peak extraction methods and through an identification process of identifying if the remainder signal region corresponds to a true peaks spectrum, the true peaks spectrum has a state in which noise peaks are removed and much information about the audio signal is included.

According to the present invention, it is identified whether or not a remainder signal region corresponds to a true peaks spectrum by using an SSS based on pitch information. When an initial SSS is determined by using a pitch detected by the pitch detector, it is identified whether or not a remainder signal region obtained through a morphological operation according to the initial SSS corresponds to a true peaks spectrum, as described below.

A method for identifying whether or not a remainder signal region corresponds to a true peaks spectrum is as follows.

1. A true peaks spectrum includes only one peak within one SSS.

2. A distance between peaks in the true peaks spectrum is the same as the SSS or has a value within a predetermined acceptable range.

Herein, although the predetermined acceptable range may vary according to the system configurations of an audio signal spectrum information estimation apparatus, it is preferable that the predetermined acceptable range is within 0.1 times the length of an SSS. Accordingly, when the two conditions are satisfied, the remainder signal region corresponds to a true peaks spectrum. However, when the two conditions are not satisfied, the SSS determiner 104 changes the initial SSS so that the two conditions can be satisfied.

In this case, the SSS determiner 104 repeatedly changes the initial SSS until it is determined that a remainder signal region according to the changed SSS corresponds to a true peaks spectrum. Such a repeated SSS change excludes remainder signal characteristic points not corresponding to the true peaks spectrum, for example, two or more remainder signal characteristic points existing in one SSS, and a distance between remainder signal characteristic points is neither the same as the SSS nor within the predetermined acceptable range.

Meanwhile, the remainder signal region extracted by the remainder signal extractor 106 is provided to the spectral envelope detector 107.

The spectral envelope detector 107 detects a spectral envelope of an audio signal by performing an interpolation operation on the true peaks spectrum extracted by the remainder signal extractor 106.

Figure 2:
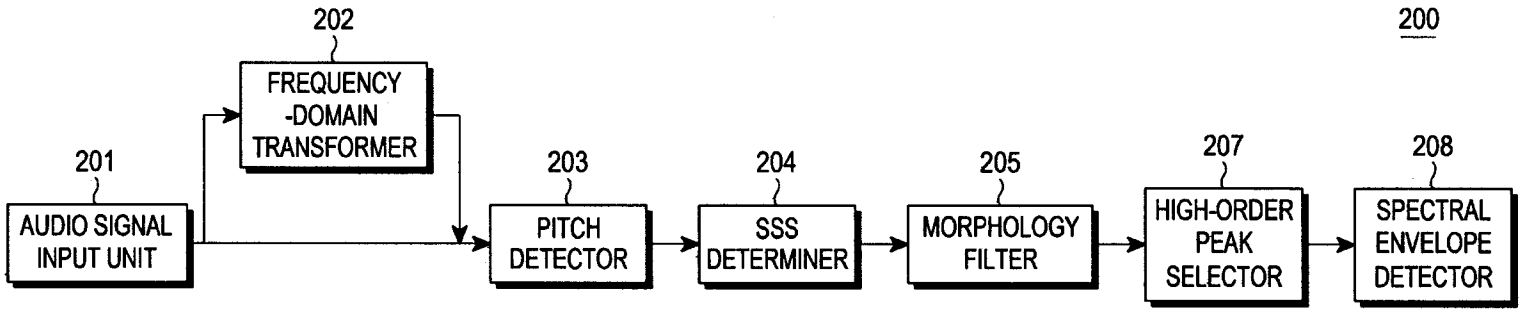
FIG. 2 is a block diagram illustrating the configuration of an apparatus for estimating spectral information of an audio signal according to another exemplary embodiment of the present invention.

FIG. 2 is a block diagram illustrating the configuration of an apparatus for estimating spectral information of an audio signal according to another exemplary embodiment of the present invention. The audio signal spectrum information estimation apparatus 200 according to said other exemplary embodiment of the present invention includes an audio signal input unit 201, a frequency-domain transformer 202, a pitch detector 203, an SSS determiner 204, a morphology filter 205, a remainder signal extractor 206, a high-order peak selector 207 and a spectral envelope detector 208.

Herein, the audio signal spectrum information estimation apparatus 200 of FIG. 2 further includes the high-order peak selector 207. The configurations of the audio signal input unit 101, the frequency-domain transformer 102, the pitch detector 103 and the morphology filter 105 in the audio signal spectrum information estimation apparatus 100 shown in FIG. 1 are the same as the audio signal input unit 201, the frequency-domain transformer 202, the pitch detector 203 and the morphology filter 205 in the audio signal spectrum information estimation apparatus 200 shown in FIG. 2, respectively. Hereinafter, the description of the same configurations will be omitted.

The high-order peak selector 207 extracts peaks from an audio signal waveform, which has been subjected to the morphological operation by the morphology filter 205, through the use of a peak extraction method, and extracts a remainder signal region from the extracted peaks. The peak extraction method includes a hitting peak method, a mid-point method and a pitch-based method, similarly to the peak extraction method used in the audio signal spectrum information estimation apparatus 100 of FIG. 1.

The order of each remainder signal characteristic point (i.e., each peak) in the remainder signal region is defined by a theorem on high-order peaks. A high-order peaks spectrum of a predetermined order, which includes the most information about the audio signal and is effective in removing noise peaks, is selected.

The theorem on high-order peaks is as follows.

1. Only one valley (or peak) exists between consecutive peaks (or valleys).

2. Theorem 1 is applied to the peaks (or valleys) of each order.

3. The number of higher-order peaks (or valleys) is less than that of lower-order peaks (or valleys), and the higher-order peaks (or valleys) exist between the lower-order peaks (or valleys).

4. At least one lower-order peak (or valley) always exists between any two consecutive high-order peaks (or valleys).

5. The high-order peaks (or valleys) have higher (or lower) level amplitudes than the lower-order peaks (or valleys) on the average.

6. During a specific duration (e.g., during a single frame), there exists an order having a single peak and valley (e.g., the maximum value and the minimum value in the single frame).

The high-order peak selector 207 first defines the extracted remainder signal region as a first-order peaks spectrum, and newly defines higher peaks between the first-order peaks as a second-order peaks spectrum. Additionally, the high-order peak selector 206 defines higher peaks between the newly defined second-order peaks as a third-order peaks spectrum. Also, high-order valleys spectrums may be defined in the same manner as described above.

Such a high-order peaks spectrum or high-order valleys spectrum may be used as very effective statistical values in extracting the characteristics of audio and sound signals, and particularly the second-order and third-order peaks spectrums among the high-order peaks spectrums have the pitch information of the audio and sound signals. In addition, a time between the second-order peaks and the third-order peaks and the number of sampling points also greatly affect the extraction of information of the audio and sound signals. It is preferable for the high-order peak selector 207 to select the second-order peaks spectrum or the third-order peaks spectrum.

The high-order peak selector 207 selects an order through the use of a ratio "Rn" of the total energy of the selected $N^{th}$ order peaks spectrum to energy of the remainder signal region of the $N^{th}$ order peaks spectrum. The order selection method of the high-order peak selector 207 will be described in the description of an audio signal spectrum information estimation method to be explained below.

Meanwhile, the high-order peak selector 207 identifies whether or not the high-order peaks spectrum corresponds to a true peaks spectrum. The true peaks spectrum does not simply represent a high-order peaks spectrum, but rather, it represents a high-order peaks spectrum finally identified for detecting spectral envelopes. Since the true peaks spectrum is the final spectrum, which has been obtained through a remainder signal region extraction process using various peak extraction methods, an order selection process for the high-order peaks spectrum, and an SSS change process described below, the true peaks spectrum has a state in which noise peaks are removed and much information about the audio signal is included.

According to the present invention, it is identified whether or not a high-order peaks spectrum corresponds to a true peaks spectrum by using an SSS based on pitch information. When an initial SSS has been determined through the use of a pitch detected by the pitch detector, as described above, it is possible to identify whether or not a high-order peaks spectrum corresponds to a true peaks spectrum, as described below.

A method for identifying whether or not a high-order peaks spectrum corresponds to a true peaks spectrum is as follows.

1. A true peaks spectrum includes only one peak within one SSS.

2. A distance between peaks in the true peaks spectrum is the same as the SSS or has a value within a predetermined acceptable range.

Herein, although the predetermined acceptable range may vary depending on the configurations of the audio signal spectrum information estimation apparatus 200, it is preferable that the predetermined acceptable range is within 0.1 times the length of an SSS. Accordingly, when the two conditions are satisfied, the high-order peaks spectrum corresponds to a true peaks spectrum.

However, when the two conditions are not satisfied, the SSS determiner 204 changes the initial SSS so that the two conditions can be satisfied. The SSS determiner 204 repeatedly changes the initial SSS until it is determined that a high-order peaks spectrum according to the changed SSS corresponds to a true peaks spectrum. Such a repeated SSS change excludes high-order peaks not corresponding to the true peaks spectrum, for example, when two or more high-order peaks exist in one SSS, and a distance between high-order peaks is neither the same as the SSS nor within the predetermined acceptable range.

The SSS determiner 204 determines an SSS for optimizing the performance of the morphology filter 205, in which the SSS may be determined according to each frame of an audio signal. In a first frame of an audio signal, a pitch period of the audio signal is determined as an initial SSS. Such a pitch of the audio signal is detected by the pitch detector 203 and provided to the SSS determiner 204. In frames subsequent to the first frame of the audio signal, an SSS of a just preceding frame of each frame is determined as an initial SSS for the corresponding frame.

Meanwhile, the high-order peaks spectrum finally selected by the high-order peak selector 207 is provided to the spectral envelope detector 208.

The spectral envelope detector 208 performs an interpolation operation on true peaks spectrums of a predetermined order, which has been selected by the high-order peak selector 207, and detects a spectral envelope of an audio signal.

According to an exemplary embodiment of the present invention, the high-order peak selector 207 may extract all of a $1^{st}$-order peak (or a $1^{st}$-order peaks spectrum), a $2^{nd}$-order peak (or a $2^{nd}$-order peaks spectrum), a $3^{rd}$-order peak (or a $3^{rd}$-order peaks spectrum), . . . , and an $N^{th}$-order peak (or an $N^{th}$-order peaks spectrum). The $1^{st}$-order through $N^{th}$-order peaks (or peaks spectral) extracted by the high-order peak selector 207 may be stored in the audio signal spectrum information estimation apparatus 200 or may be output to a frame comparator 700 which will be described later.

As such, the high-order peak selector 207 extracts a peak from a signal of a frequency domain output from the frequency-domain transformer 202. The audio signal transformed into the frequency domain includes more original data in a portion having a high frequency value than in a portion having a low frequency value. Therefore, the high-order peak selector 207 according to the present invention extracts a peak from the audio signal transformed into the frequency domain, thereby preventing essentially necessary data from being missed out in processing of the audio signal. In the audio signal transformed into the frequency domain, a peak may be a frequency characteristic value of the audio signal.

According to another exemplary embodiment of the present invention, the high-order peak selector 207 may output frequency values of a $1^{st}$-order peak, a $2^{nd}$-order peak, a $3^{rd}$-order peak, . . . , and an $N^{th}$-order peak which are extracted for each frame of the audio signal, or a result of an operation with respect to the peaks, such as an average, a standard deviation, a gradient, or the like to the frame comparator 700.

Figure 3:
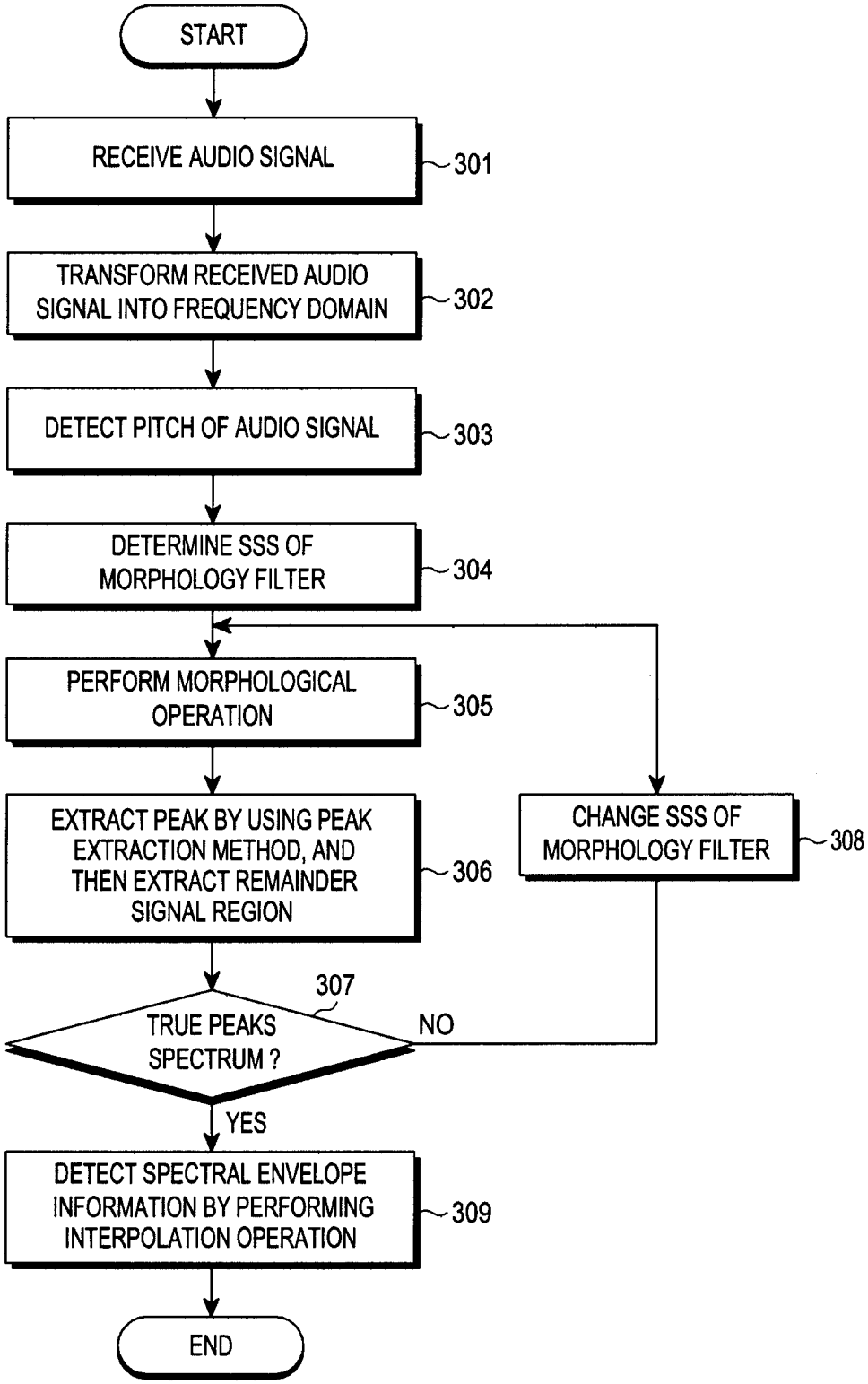
FIG. 3 is a flowchart illustrating a method for estimating spectral information of an audio signal according to an exemplary embodiment of the present invention.

Hereinafter, a method for estimating spectral information of an audio signal according to an exemplary embodiment of the present invention will be described in detail. FIG. 3 is a flowchart illustrating a method for estimating spectral information of an audio signal according to an exemplary embodiment of the present invention. Here, the estimation method is implemented by using the audio signal spectrum information estimation apparatus 100 shown in FIG. 1.

Referring to FIG. 3, the audio signal input unit 101 receives an audio signal through a microphone and the like in step 301. In step 302, the received audio signal in a time domain is transformed into an audio signal in a frequency domain by using a Fast Fourier Transform (FFT) and the like. Step 302 may be selectively included in the audio signal spectrum information estimation method. Meanwhile, such an audio signal in the time domain or frequency domain may be processed frame by frame.

After the audio signal in the time domain has been transformed into the audio signal in the frequency domain, the pitch of the received audio signal is detected by using the pitch detector in step 303, and the pitch information is provided to the SSS determiner 104. According to an exemplary embodiment of the present invention, the spectrum information estimation apparatus 100 may detect a positive (+) pitch or a negative (−) pitch of the audio signal in step 303. The spectrum information estimation apparatus 100 may also detect both of the positive pitch and the negative pitch in step 303.

In step 304, the SSS determiner 104 calculates the period of the pitch and determines the calculated period as an initial SSS for the first frame of the audio signal.

When the initial SSS has been determined, the spectrum information estimation apparatus performs a morphological operation on the audio signal waveform in the frequency domain by using a sliding window according to the initial SSS in step 305. In this case, the dilation, erosion, opening, and closing operations may be used as the morphological operation.

Figure 5:
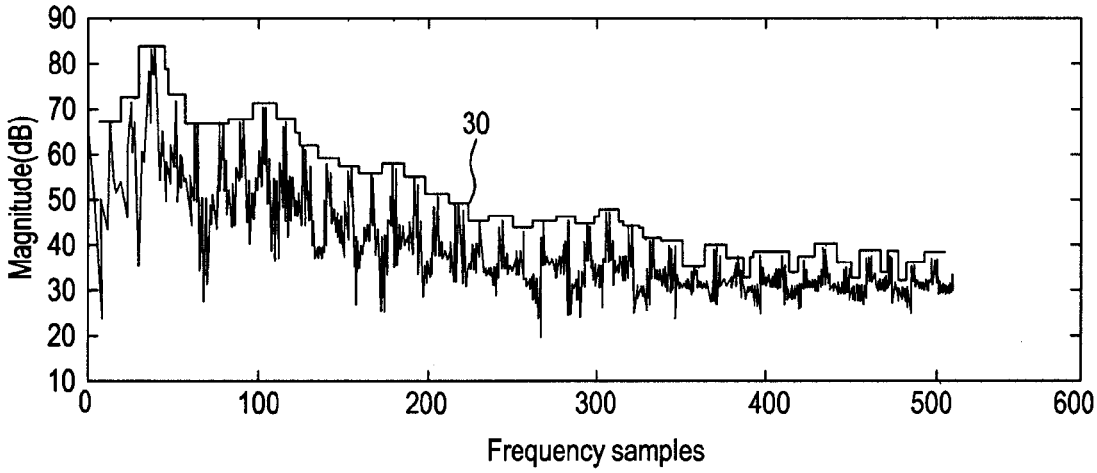
FIG. 5 is a view illustrating a result of a dilation operation of a morphological operation according to an exemplary embodiment of the present invention.

FIG. 5 is a view illustrating a result of the dilation operation according to an exemplary embodiment of the present invention. When the dilation operation is performed, the audio signal spectrum information estimation apparatus determines a maximum value within each predetermined sliding window of the audio signal as a value of the corresponding sliding window frame. Accordingly, when the dilation operation has been performed on an audio signal, a discontinuous discrete signal waveform in which each dilated region has a maximum value of the corresponding sliding window frame is generated as shown in FIG. 5.

Figure 6:
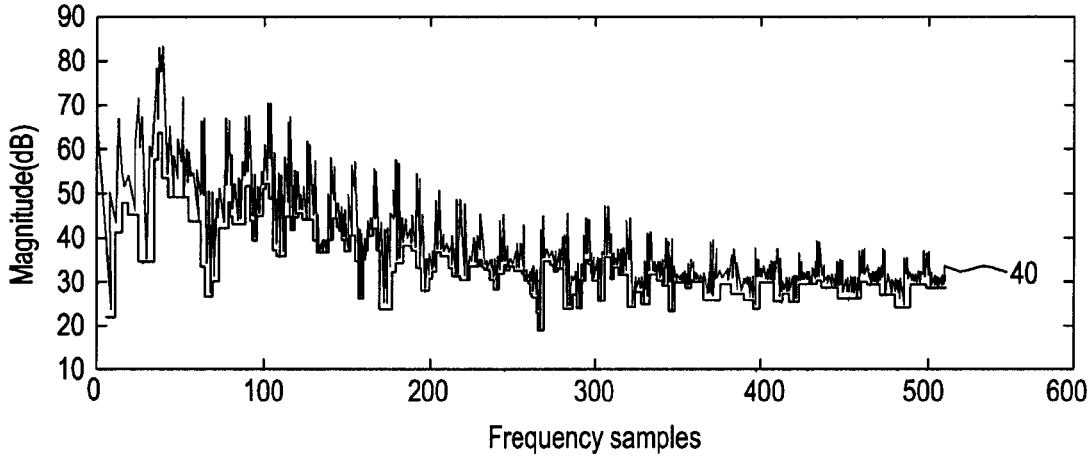
FIG. 6 is a view illustrating a result of an erosion operation of a morphological operation according to an exemplary embodiment of the present invention.

Meanwhile, FIG. 6 is a view illustrating a result of the erosion operation according to an exemplary embodiment of the present invention. When the erosion operation is performed, the audio signal spectrum information estimation apparatus determines a minimum value within a predetermined sliding window frame of an audio signal image as a value of the corresponding sliding window frame. Accordingly, when the erosion operation has been performed on an audio signal waveform, a discontinuous discrete signal waveform image in which each eroded region constantly has a minimum value of the corresponding sliding window frame is generated as shown in FIG. 6.

After the morphological operation has been performed, high-order peak selector 207 extracts peaks from the audio signal waveform, which has been subjected to the morphological operation, by means of a peak extraction method, and extracts a remainder signal region in step 306. In this case, high-order peak selector 207 can extract the peaks by using any one peak extraction method among a hitting peak method, a mid-point method, and a pitch-based method.

Figure 7:
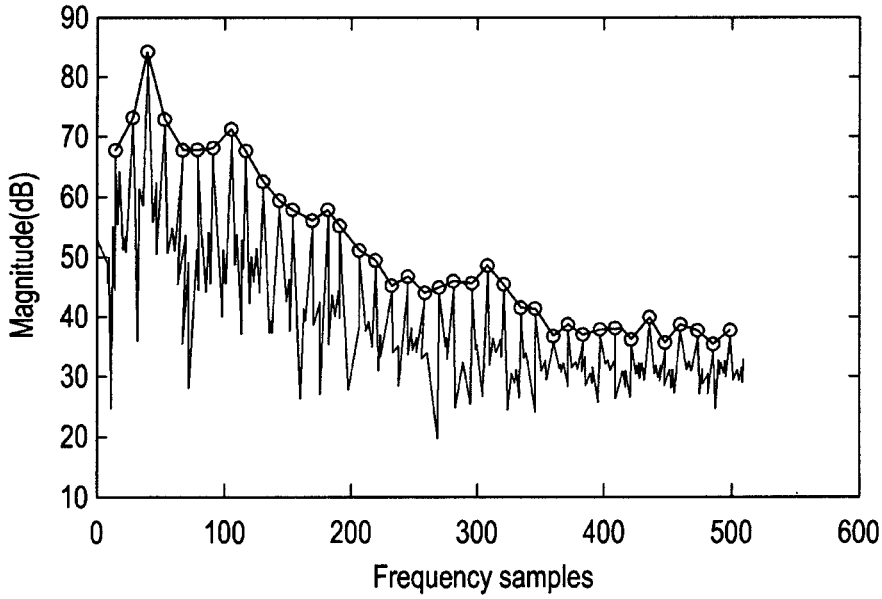
FIG. 7 is a view illustrating an example in which an interpolation operation has been performed on a remainder signal region by applying a hitting peak method according to an exemplary embodiment of the present invention.

The hitting peak method is a method for extracting the meeting point of each peak of the audio signal waveform and a dilated or eroded region, as a remainder signal characteristic point. FIG. 7 is a view illustrating an example in which an interpolation operation has been performed on a remainder signal region by applying the hitting peak method. Circles correspond to remainder signal characteristic points extracted through the hitting peak method. The spectrum information estimation apparatus performs the interpolation operation on the remainder signal characteristic points, thereby detecting spectral envelope information of the audio signal.

Figure 8:
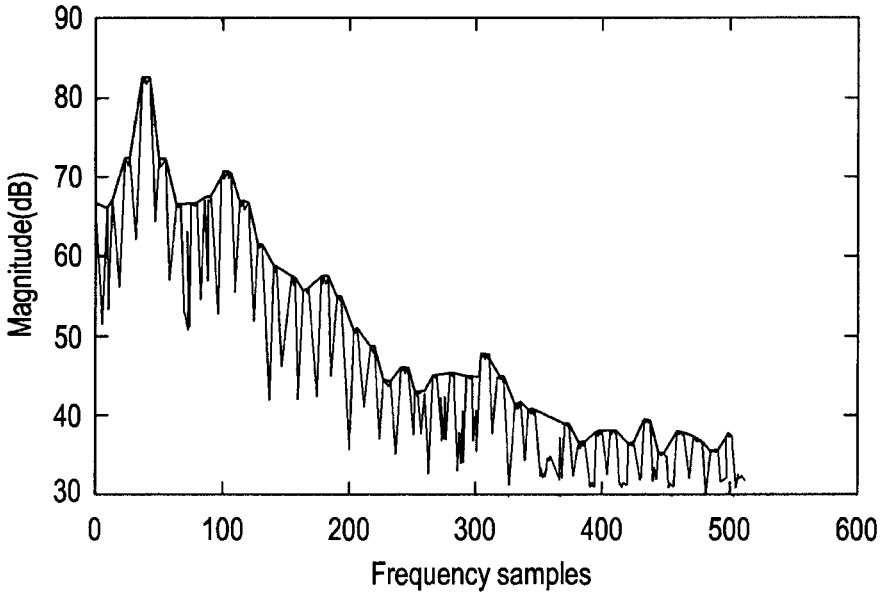
FIG. 8 is a view illustrating an example in which an interpolation operation has been performed on a remainder signal region by applying a mid-point method according to an exemplary embodiment of the present invention.

The mid-point method is a method for extracting the mid-point of each dilated region or eroded region as a peak. FIG. 8 is a view illustrating an example in which an interpolation operation has been performed on a remainder signal region by applying the mid-point method. The spectrum information estimation apparatus performs the interpolation operation on the midpoints of each dilated region or each eroded region, thereby detecting spectral envelope information of the audio signal.

The pitch-based method is a method for extracting actual peaks which cause an audio signal waveform to be dilated or eroded irrespective of sliding window frames. FIG. 9 is a view illustrating an example in which an interpolation operation has been performed on a remainder signal region by applying the pitch-based method. Circles correspond to actual peaks extracted through the pitch-based method. The spectrum information estimation apparatus performs the interpolation operation on the extracted actual peaks, thereby detecting spectral envelope information of the audio signal.

Then, the remainder signal extractor 106 extracts a remainder signal region from the extracted peaks. Here, the remainder signal region represents a region, except for a stair-case signal portion, among peaks which are extracted, by using one method among the aforementioned peak extraction methods, from an audio signal (closure floor) which has been subjected to the closing operation of the morphological operation.

In step 307, the remainder signal extractor 106 identifies whether or not the remainder signal region corresponds to a true peaks spectrum. As described in the description of the audio signal spectrum information estimation apparatus, the method for identifying whether or not a remainder signal region corresponds to a true peaks spectrum is as follows.

1. A true peaks spectrum includes only one peak within one SSS.

2. A distance between peaks in the true peaks spectrum is the same as the SSS or has a value within a predetermined acceptable range.

Herein, although the predetermined acceptable range may vary depending on the audio signal spectrum information estimation apparatus 100, it is preferable that the predetermined acceptable range is within 0.1 times the length of an SSS. When a remainder signal region satisfies the two conditions, the remainder signal region corresponds to a true peaks spectrum. In this case, the spectral envelope detector 107 performs the interpolation operation on the true peaks spectrum and detects a spectral envelope in step 309. However, when the two conditions are not satisfied, the SSS determiner 104 changes the initial SSS so that the two conditions can be satisfied in step 308. In this case, steps 305 to 308 are repeated to change the initial SSS until it is determined that a corresponding remainder signal region corresponds to a true peaks spectrum.

Herein, the SSS change method of the morphology filter 105 is as follows.

1. Decreasing the value of an SSS when two or more remainder signal characteristic points exist within one sliding window frame, and increasing the value of an SSS when no remainder signal characteristic point exists within one sliding window frame.

2. Decreasing the value of an SSS when a distance between remainder signal characteristic points is less than the value of the SSS, and increasing the value of an SSS when a distance between remainder signal characteristic points is greater than the value of the SSS.

By using one of the SSS change methods of the morphology filter 105, the SSS determiner 104 can automatically change the value of an SSS. When it is identified that a remainder signal region based on the changed SSS corresponds to a true peaks spectrum, the spectral envelope detector 107 detects a spectral envelope by performing the interpolation operation on the true peaks spectrum in step 309, and then ends the procedure.

According to an embodiment of the present invention, however, since the initial SSS is determined by a morphological operation using pitch information, when the SSS is determined to be too small a value due to a pitch error or the like, the spectral envelope information may be distorted due to too many noise peaks included therein. Meanwhile, when the SSS is determined to be too large a value, the remainder signal characteristic points are missed. Therefore, in order to prevent such a problem, it is necessary to remove incorrectly selected noise peaks before the interpolation operation is performed. To this end, a method for selecting a high-order peaks spectrum may be employed. The step of selecting a high-order peaks spectrum may be selectively included in the audio signal spectrum information estimation method.

Figure 4:
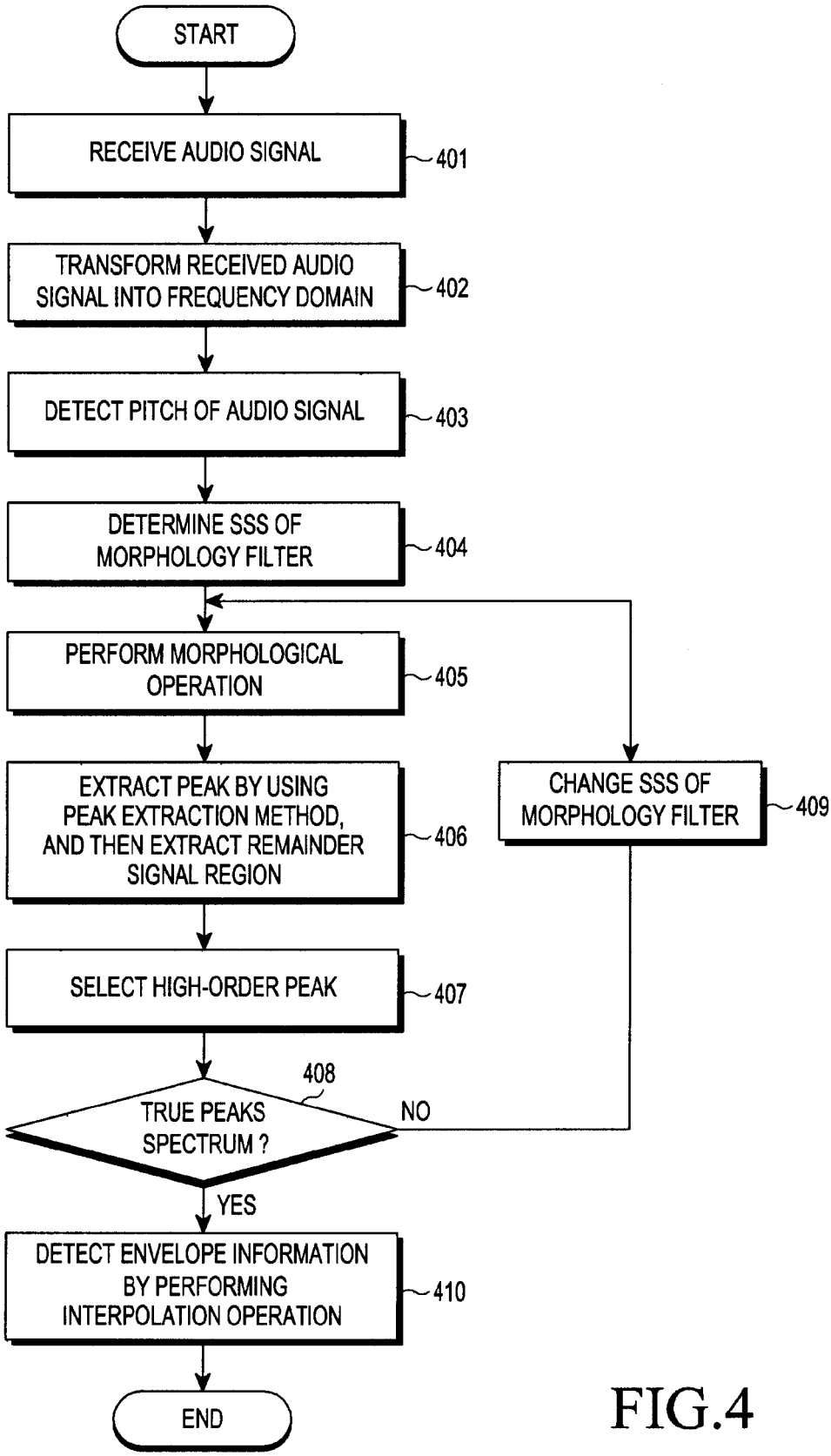
FIG. 4 is a flowchart illustrating a method for estimating spectral information of an audio signal according to another exemplary embodiment of the present invention.

Hereinafter, a method for estimating spectrum information of an audio signal according to another exemplary embodiment of the present invention will be described in detail. FIG. 4 is a flowchart illustrating the method for estimating spectrum information of an audio signal according to said other exemplary embodiment of the present invention. The audio signal spectrum information estimation method is implemented by using the audio signal spectrum information estimation apparatus 200 shown in FIG. 2.

Referring to FIG. 4, the audio signal spectrum information estimation method according to said other exemplary embodiment of the present invention further includes step 407 of selecting a high-order peaks spectrum in addition to the steps included in the audio signal spectrum information estimation method of FIG. 3.

Meanwhile, the operations of steps 301 to 305 in FIG. 3 are the same as steps 401 to 405 in FIG. 4, respectively. Hereinafter, a description of the same operation will be omitted.

In step 406, the high-order peak selector 207 extracts peaks from an audio signal waveform, which has been subjected to the morphological operation by the morphology filter 205, through the use of a peak extraction method, and extracts a remainder signal region from the extracted peaks. The peak extraction method includes a hitting peak method, a mid-point method, and a pitch-based method, and is the same as the remainder signal region extraction method described with reference to FIG. 3.

The high-order peak selector 207 selects a high-order peaks spectrum from the remainder signal region in step 407. The high-order peak selector 207 defines an order of each remainder signal characteristic point and selects a high-order peaks spectrum which includes the most information about the audio signal and is suitable for removing noise peaks.

Hereinafter, step 407 of selecting a high-order peaks spectrum will be described in detail with reference to FIGS. 10 to 13.

FIGS. 10A to 10B are views illustrating a step of defining high-order peaks according to an exemplary embodiment of the present invention. The audio signal spectrum information estimation apparatus 200 defines remainder signal characteristic points extracted by the high-order peak selector 207 as first-order peaks P1, as shown in FIG. 10A. Then, the spectrum information estimation apparatus 200 detects peaks P2 appearing when the first-order peaks P1 have been connected, as shown in FIG. 10B. The detected peaks P2 are defined as the second-order peaks, as shown in FIG. 10C. Although FIGS. 10A to 10C illustrate the defining procedure up to the second-order peaks, the third-order peaks may be defined from the second-order peaks, and thus $N^{th}$ order peaks (wherein, N is a natural number) may be defined in the same manner. In this case, there are many cases where the second-order and third-order peaks among the high-order peaks include much information of the audio and sound signals.

Figure 11:
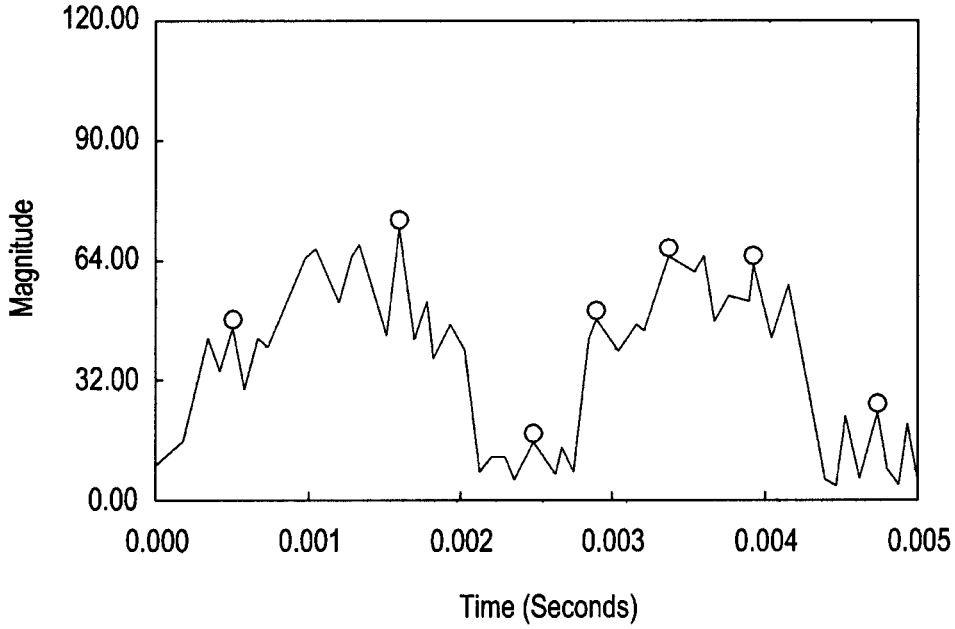
FIG. 11 is a view illustrating a case where the second-order peaks are selected according to an exemplary embodiment of the present invention.

FIG. 11 is a view illustrating a case where the second-order peaks are selected according to an exemplary embodiment of the present invention. FIG. 11 illustrates 200 Hz sinusoidal signals in Gaussian noise, wherein circles represent the selected second-order peaks.

Figure 12:
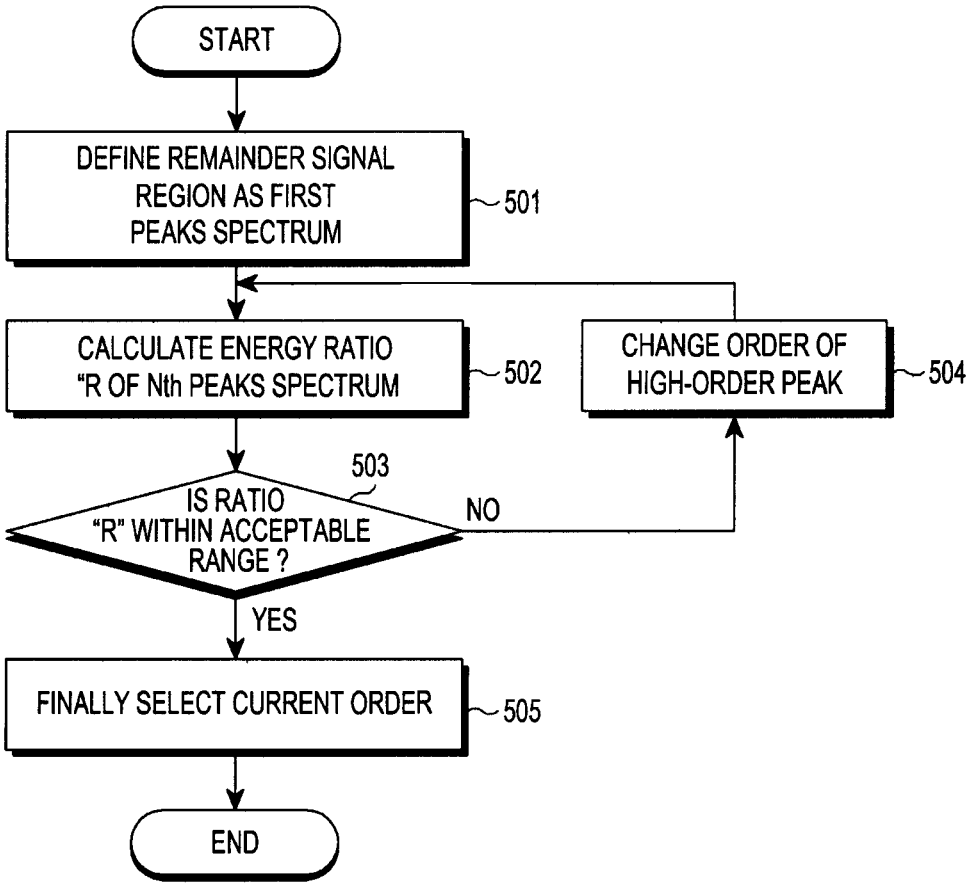
FIG. 12 is a flowchart illustrating a method for selecting an order of high-order peaks according to an exemplary embodiment of the present invention.

FIG. 12 is a flowchart illustrating a method of selecting an order of a high-order peaks spectrum according to an exemplary embodiment of the present invention. In step 501, the high-order peak selector 207 defines remainder signal characteristic points extracted by the high-order peak selector 207 as first-order peaks.

In step 502, the high-order peak selector 207 calculates a ratio "R1" of the total energy of the first-order peaks spectrum to energy of the remainder signal region among the first-order peaks spectrum. Herein, the remainder signal region includes peaks containing the information of the audio signal, and ratio "Rn" is defined by following Equation (2).

$$\text{Ratio}(Rn) = \frac{\text{Total energy of remainder signal region}}{\text{Total energy of } N^{th} \text{ order peaks}} \quad (2)$$

Figure 13A:
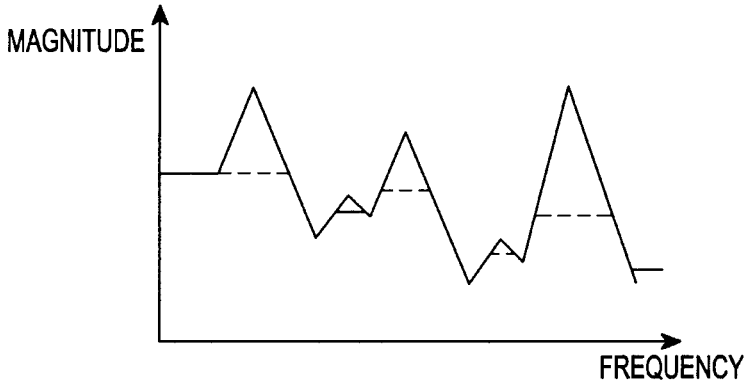
FIGS. 13A and 13B are conceptual views illustrating an energy ratio "Rn" of a remainder signal region according to an exemplary embodiment of the present invention.
Figure 13B:
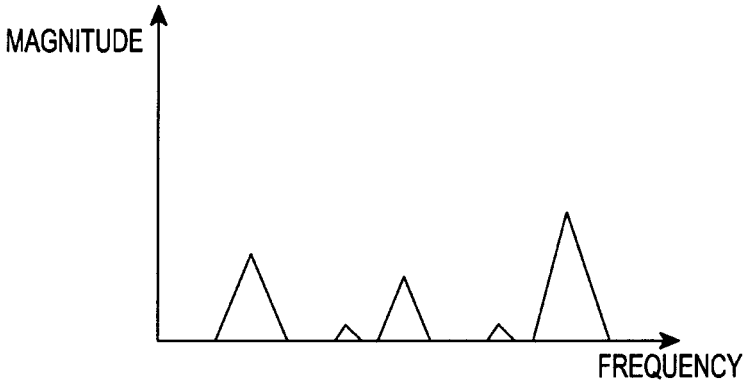

FIGS. 13A and 13B are conceptual views illustrating an energy ratio "Rn" of a remainder signal region of an $N^{th}$ order peaks spectrum according to an exemplary embodiment of the present invention. FIG. 13A illustrates an audio signal (closure floor) which has been subjected to a morphological operation through a closing operation and has been extracted by a peak extraction method. FIG. 13B illustrates a spectrum of a remainder signal region obtained by excluding stair-case signals through the closing operation. According to the present invention, a remainder signal region of peaks is extracted differently from the conventional method, in which a ratio similar to the ratio of Equation (2) is calculated using a remainder spectrum constituted with only five to fifteen of the highest peaks. Accordingly, the energy ratio "Rn" of the remainder signal region can be calculated without missing even insignificant information of the audio signal.

In step 503, it is determined whether or not the energy ratio "Rn" of the remainder signal region of the $N^{th}$ order peak to the total energy of the $N^{th}$ order peak has a value within a predetermined acceptable range.

In this case, when the energy ratio "Rn" of the remainder signal region has a value within the acceptable range, the high-order peak selector 207 selects the current order as the final order in step 505. In contrast, when it is determined that the ratio "Rn" has a value out of the acceptable range, the high-order peak selector 207 changes the order of the high-order peaks spectrum in step 504. In this case, if the ratio "Rn" is above the acceptable range, the high-order peak selector 207 increases the current order by one. In contrast, if the ratio "Rn" is below the acceptable range, the high-order peak selector 207 decreases the current order by one.

In this manner, the high-order peak selector 207 repeatedly performs steps 502 to 504 until the current order of the high-order peaks spectrum has a value within the acceptable range.

Herein, the acceptable range may be a fixed range or may vary. That is, the acceptable range may be determined in such a manner as to lower the acceptable range when a signal-to-noise ratio (SNR) is equal to or greater than a predetermined threshold, and to raise the acceptable range when the SNR is less than the predetermined threshold. Although the case where the SNR is equal to or greater than the predetermined threshold is variable depending on the configuration of the audio signal spectrum information estimation apparatus 200, the case may correspond to a state in which a distortion of an audio signal is reduced or removed, and thus the envelope of the audio signal can be estimated.

Meanwhile, it is preferable that the acceptable range is from 0.2 to 0.4 (i.e., from 20% to 40%).

After selecting a high-order peaks spectrum in step 407, the high-order peak selector 206 identifies whether or not the selected high-order peaks spectrum corresponds to a true peaks spectrum in step 408.

As described in the description of the audio signal spectrum information estimation apparatus, the method for identifying whether or not a high-order peaks spectrum corresponds to a true peaks spectrum is as follows.

1. A true peaks spectrum includes only one peak within one SSS.

2. A distance between peaks in the true peaks spectrum is the same as the SSS or has a value within a predetermined acceptable range.

Herein, although the predetermined acceptable range may vary depending on the audio signal spectrum information estimation apparatus 200, it is preferable that the predetermined acceptable range is within 0.1 times the length of an SSS. When a high-order peaks spectrum satisfies the two conditions, the high-order peaks spectrum corresponds to a true peaks spectrum. In this case, the spectral envelope detector 207 performs the interpolation operation on the true peaks spectrum and detects a spectral envelope in step 410. However, when the two conditions are not satisfied, the SSS determiner 204 changes the initial SSS so that the two conditions can be satisfied in step 409. In this case, steps 405 to 409 are repeated to change the initial SSS until it is determined that a corresponding high-order peaks spectrum corresponds to a true peaks spectrum.

Herein, the SSS change method of the morphology filter 205 is as follows.

1. Decreasing the value of an SSS when two or more high-order peaks exist within one sliding window frame, and increasing the value of an SSS when no high-order peaks exist within one sliding window frame.

2. Decreasing the value of an SSS when a distance between high-order peaks is less than the value of the SSS, and increasing the value of an SSS when a distance between high-order peaks is greater than the value of the SSS.

By using one of the SSS change methods of the morphology filter 205, the SSS determiner 204 can automatically change the value of an SSS. When it is identified that a high-order peaks spectrum based on the changed SSS corresponds to a true peaks spectrum, the spectral envelope detector 207 detects a spectral envelope by performing the interpolation operation on the true peaks spectrum in step 410, and then ends the procedure.

Meanwhile, the embodiments of the present invention are provided for illustration only, and not for the purpose of limiting the present invention.

As described above, according to the present invention, it is possible to automatically estimate audio signal spectrum information from which noise peaks have been removed. In detail, according to the present invention, it is possible to extract a true peaks spectrum, from which noise peaks have been removed, by using the peak information according to the peak extraction method of the present invention. In addition, it is possible to prevent information of audio signals from being lost by using the concept of the energy ratio "Rn" of a remainder signal region in order to select an order of high-order peaks.

Also, according to the present invention, audio signals can be processed more accurately without noise through the change of an SSS by the morphology filter.

Figure 14:
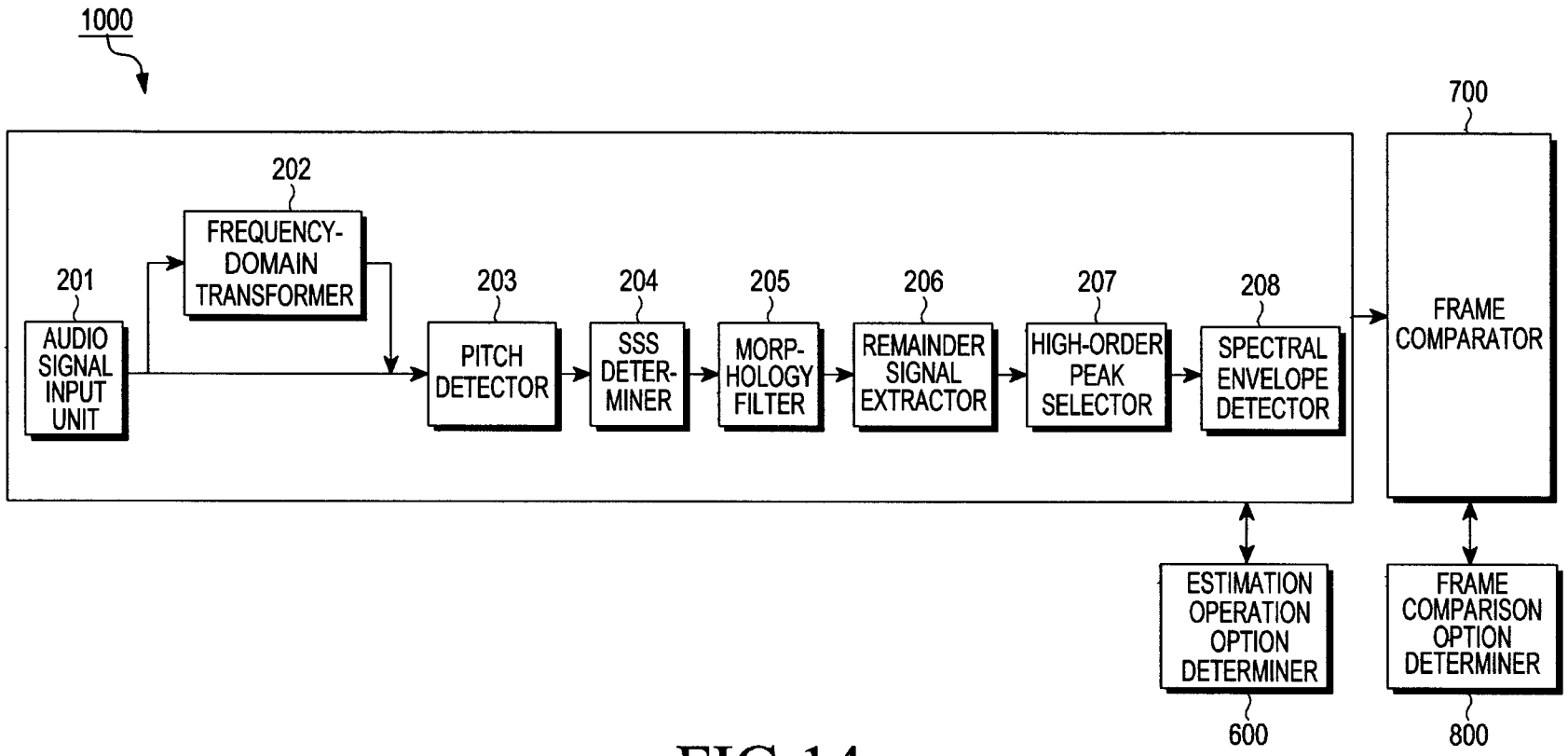
FIG. 14 is a block diagram of an apparatus for comparing frames according to an exemplary embodiment of the present invention.

FIG. 14 is a block diagram of an apparatus for comparing frames according to an exemplary embodiment of the present invention.

Referring to FIG. 14, a frame comparison apparatus 1000 may include a spectrum information estimation apparatus 200, an estimation operation option determiner 600, a frame comparator 700, and a frame comparison option determiner 800.

The spectrum information estimation apparatus 200 may include the audio signal input unit 201, the frequency-domain transformer 202, and the high-order peak selector 207, and may further include the pitch detector 203, the SSS determiner 204, the morphology filter 205, the remainder signal extractor 206, and the spectral envelope detector 208.

In the present invention, spectrum information estimated by the spectrum information estimation apparatus 200 may be frequencies of peaks included in the audio signal transformed into the frequency domain. That is, the high-order peak selector 207 of the spectrum information estimation apparatus 200 extracts peaks included in the audio signal transformed into the frequency domain. In addition, the high-order peak selector 207 may output frequency values of the respective peaks to the frame comparator 700.

The spectrum information estimation apparatus 200 shown in FIG. 14 has the same configuration as the spectrum information estimation apparatus 200 shown in FIG. 2, and thus will not be described in detail.

The estimation operation option determiner 600 determines an estimation order of spectrum information for each frame operated by the spectrum information estimation apparatus 200. The estimation operation option determiner 600 may determine a final order of a peak or a peak spectrum operated by the spectrum information estimation apparatus 200. For example, the estimation operation option determiner 600 may control peaks extracted by the high-order peak selector 207 of the spectrum information estimation apparatus 200 to be extracted from a $1^{st}$-order peak to a $5^{th}$-order peak. According to an exemplary embodiment of the present invention, peaks or peak spectra operated by the spectrum information estimation apparatus 200 all may be stored. For example, the spectrum information estimation apparatus 200 may perform an operation with respect to $1^{st}$-order through $5^{th}$-order peak spectra according to determination of the estimation operation option determiner 600, and may store all of the $1^{st}$-order through $5^{th}$-order peak spectra in the spectrum information estimation apparatus 200 or output them to the frame comparator 700.

According to an exemplary embodiment of the present invention, the estimation operation option determiner 600 may determine an order of a peak or a peak spectrum extracted by the high-order peak selector 207 based on a signal-to-noise ratio (SNR) or a noise level of an audio signal input through the audio signal input unit 201. Preferably, the estimation operation option determiner 600 may determine an order of a peak or a peak spectrum extracted by the high-order peak selector 207 as a higher order as the audio signal input through the audio signal input unit 201 has more noise.

The frame comparator 700 compares frames whose spectrum information have been estimated by the spectrum information estimation apparatus 200. The frame comparator 700 first determines frames to be compared and determines a comparison range. To this end, the frame comparator 700 may include a comparison frame determination unit 710 and a comparison unit 720.

The comparison frame determination unit 710 determines frames to be compared. For example, the comparison frame determination unit 710 may determine a range of frames output from the spectrum information estimation apparatus 200 and a range of spectrum information corresponding to the respective frames. For example, it is assumed that first through fifth frames are input to the frame comparator 700 in order of 'first frame→second frame→third frame→fourth frame→fifth frame'. The frame comparator 700 is assumed to calculate a frame comparison value with respect to the third frame. The comparison frame determination unit 710 may determine the first frame, the second frame, the fourth frame, and the fifth frame as comparison frames for calculating the frame comparison value with respect to the third frame.

According to an exemplary embodiment of the present invention, the comparison frame determination unit 710 may determine the number of comparison frames according to an SNR or a noise level of an audio signal input to the audio signal input unit 201. Preferably, the comparison frame determination unit 710 may increase the number of comparison frames as the audio signal input through the audio signal input unit 201 has more noise.

The comparison frame determination unit 710 may determine a frame to be compared (comparison target frame) with respect to a current frame for which a frame comparison value is to be calculated, or determine a range of comparison target frames.

The comparison frame determination unit 710 may determine at least one of frames input before (previous frames) or at least one of frames input after (next frames) a current frame for which a frame comparison value is to be calculated, a comparison target frame for the current frame. For example, if the comparison frame determination unit 710 is assumed to determine one previous frame as a comparison target frame for the current frame, a comparison target frame for the third frame is the second frame. As another example, if the comparison frame determination unit 710 is assumed to determine one next frame as a comparison target frame for the current frame, a comparison target frame for the third frame is the fourth frame. If the comparison frame determination unit 710 is assumed to determine two previous frames and two next frames as comparison target frames for the third frame, the comparison target frames for the third frame are the first frame, the second frame, the fourth frame, and the fifth frame.

The frame comparison option determiner 800 determines a comparison option for frames to be compared by the frame comparator 700.

Herein, 'comparison option' means a comparison order of values to be compared from respective frames, for example, when two frames are to be compared. That is, when the current frame and a comparison target frame for the current frame are compared by the frame comparator 700, the frame comparison option determiner 800 may determine parameters to be compared among characteristic information (peaks, peak spectral, etc.) of the current frame and the comparison target frame. For example, if the frame comparison option determiner 800 determines that only $1^{st}$-order peaks spectra of the current frame and the comparison target frame are to be compared, the frame comparator 700 may perform an operation with respect to a $1^{st}$-order comparator 720-1 to output a result of comparison between frequencies corresponding to the $1^{st}$-order peaks of the current frame and the comparison target frame.

As another example, the frame comparison option determiner 800 may determine that $1^{st}$-order through $3^{rd}$-order peaks spectra of the current frame and the comparison target frame are to be compared.

Figure 15:
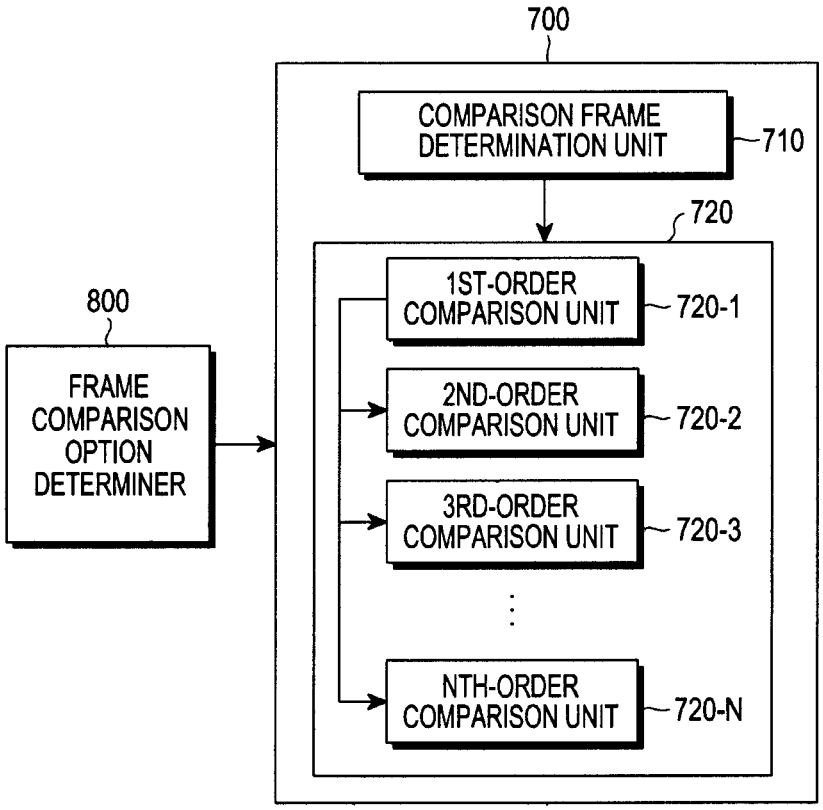
FIG. 15 is a block diagram showing structures of a comparison option determiner and a frame comparator according to an exemplary embodiment of the present invention.

FIG. 15 is a block diagram showing structures of a comparison option determiner and a frame comparator according to an exemplary embodiment of the present invention.

Referring to FIG. 15, the frame comparator 700 may include the comparison frame determination unit 710 and the comparison unit 720.

As mentioned before, the comparison frame determination unit 710 determines frames to be compared, and for example, may determine a range of frames output from the spectrum information estimation apparatus 200 and a range of spectrum information corresponding to the respective frames.

The frame comparison unit 720 compares a current frame input through comparison frame determination unit 710 with at least one comparison target frames determined in advance by the comparison frame determination unit 710, and outputs a frame comparison value as a result of the comparison. For such frame comparison, the frame comparison unit 720 may include the $1^{st}$-order comparison unit 720-1, a $2^{nd}$-order comparison unit 720-2, and a $3^{rd}$-order comparison unit 720-3 through an $N^{th}$-order comparison unit 720-N.

Preferably, values compared by the $1^{st}$-order through $N^{th}$-order comparison units 720-1 through 720-N may be spectrum information output from the spectrum information estimation apparatus 200.

The $1^{st}$-order comparison unit 720-1 may perform comparison with respect to $1^{st}$-order spectrum information, e.g., a $1^{st}$-order peaks spectrum among spectrum information of respective frames. The $2^{nd}$-order comparison unit 720-2 may perform comparison with respect to $2^{nd}$-order spectrum information, e.g., a $2^{nd}$-order peaks spectrum among spectrum information of respective frames. The $3^{rd}$-order comparison unit 720-3 may perform comparison with respect to $3^{rd}$-order spectrum information, e.g., a $3^{rd}$-order peaks spectrum among spectrum information of respective frames. In this way, the $N^{th}$-order comparison 720-N may perform comparison with respect to $N^{th}$-order spectrum information among spectrum information of respective frames.

According to another embodiment of the present invention, the frame comparison unit 720 may compare the current frame with comparison target frames for the current frame by using frequency values of $1^{st}$-order through $(N-1)^{th}$-order or $N^{th}$-order peaks extracted by the high-order peak selector 207 based on a frame comparison method, as will be described below.

First, the frame comparison unit 720 is assumed to compare a frequency of a $1^{st}$-order peaks spectrum of the current frame with a frequency of a $1^{st}$-order peaks spectrum of each of the comparison target frames for the current frame.

The $1^{st}$-order comparison unit 720-1 may perform $1^{st}$-order comparison by comparing each of frequencies $f_1, f_2, f_3, f_4, \ldots, f_M$ (M is a natural number) of the $1^{st}$-order peaks spectrum of the current frame with each of frequencies $f_1, f_2, f_3, f_4, \ldots, f_M$ of the $1^{st}$-order peaks spectrum of each of at least one comparison target frames for the current frame.

The $2^{nd}$-order comparison unit 720-2 may perform $2^{nd}$-order comparison by comparing each of $|f_1-f_2|, |f_2-f_3|, |f_3-f_4|, \ldots, |f_{M-1}-f_M|$ of the current frame with each of $|f_1-f_2|, |f_2-f_3|, |f_3-f_4|, \ldots, |f_{M-1}-f_M|$ of each of the at least one comparison target frames.

The $3^{rd}$-order comparison unit 720-3 may perform $3^{rd}$-order comparison by comparing each of $\|f_1-f_2|-|f_1-f_3\|, \|f_2-f_3|-|f_2-f_4\|, \|f_3-f_4|-|f_3-f_5\|, \ldots, \|f_{M-2}-f_{M-1}|-|f_{M-2}-f_M\|$ of the current frame with each of $\|f_1-f_2|-|f_1-f_3\|, \|f_2-f_3|-|f_2-f_4\|, \|f_3-f_4|-|f_3-f_5\|, \ldots, \|f_{M-2}-f_{M-1}|-|f_{M-2}-f_M\|$ of each of the at least one comparison target frames.

In this way, the frame comparison unit 720 performs comparison up to the $N^{th}$ order with respect to the current frame and a comparison target frame for the current frame, thus calculating a comparison result value as a result of comparison between the current frame and the comparison target frame for the current frame.

Frequency values of the current frame and the comparison target frame compared by the frame comparison unit 720 may be at least one of $1^{st}$-order through $N^{th}$-order peaks. A difference between frequencies used for comparison between frames (e.g., $f_2-f_1$, $f_3-f_2$, or the like) is not limited to the aforementioned example, and may be implemented variously as required by those of ordinary skill in the art. The $1^{st}$-order through $N^{th}$-order comparison units 720-1 through 720-N included in the frame comparison unit 720 perform more complex operations as the order increases, thereby clearly revealing a difference between the current frame and the comparison target frame. Even if the order increases, the operation executed in the frame comparison unit 720 is addition or subtraction, such that the frame comparator 700 can be easily realized with a small amount of computation.

According to another exemplary embodiment of the present invention, the frame comparison unit 720 may calculate a comparison result value by using an average value, a standard deviation, a gradient, or the like based on peaks of respective frames. For example, the $1^{st}$-order comparison unit 720-1 of the frame comparison unit 720 may compare $1^{st}$-order differentiated values of average values of peaks of respective frames, the $2^{nd}$-order comparison unit 720-2 may compare $2^{nd}$-order differentiated values of the average values, and the $3^{rd}$-order comparison unit 720-3 may compare $3^{rd}$-order differentiated values of the average values, such that the $N^{th}$-order comparison unit 720-N may compare $N^{th}$-order differentiated values of the average values and output a comparison result.

Figure 16:
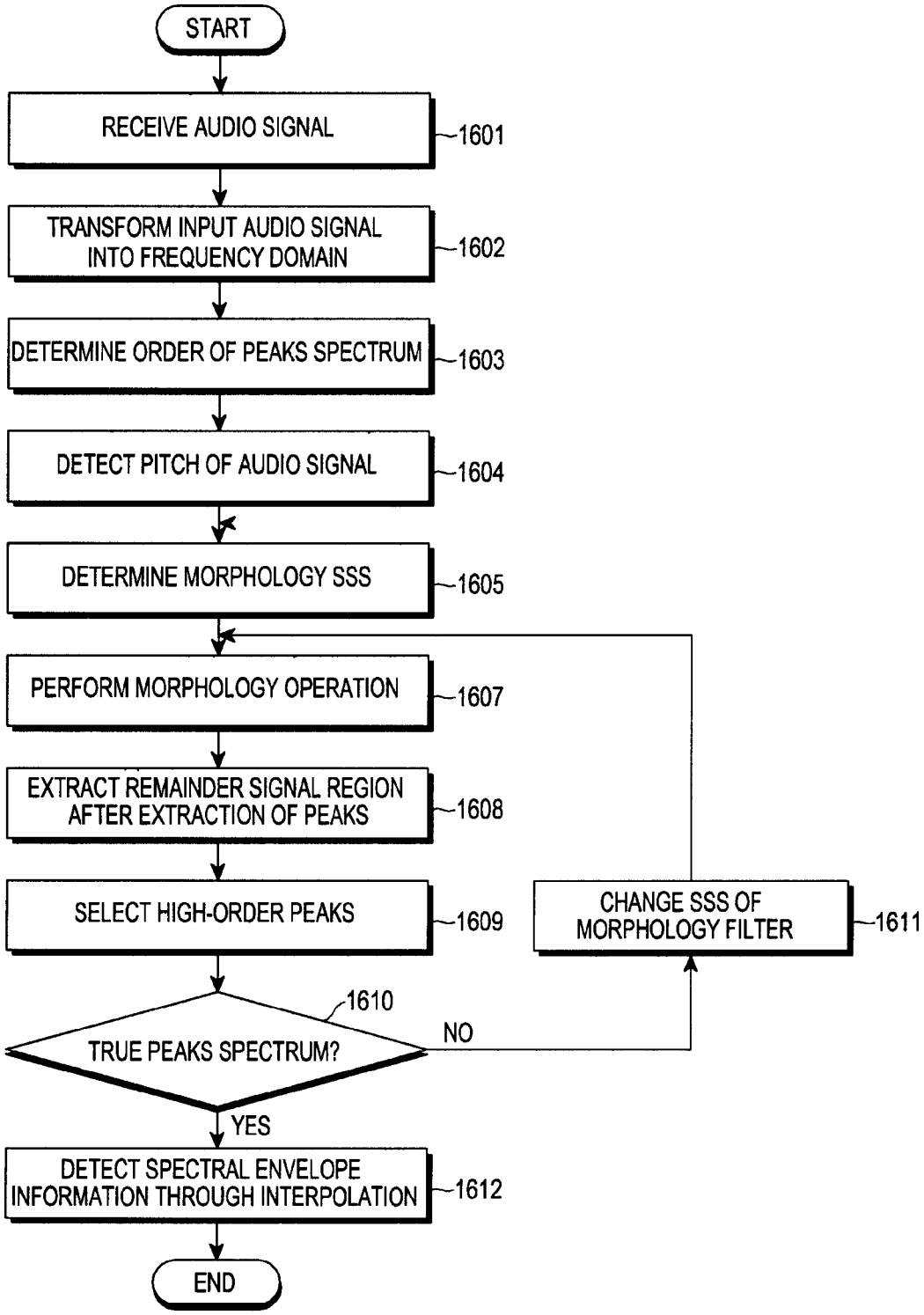
FIG. 16 is a flowchart of a method for estimating spectral information of an audio signal according to another exemplary embodiment of the present invention.

FIG. 16 is a flowchart of a method for estimating spectral information of an audio signal according to another exemplary embodiment of the present invention. The current method for estimating spectral information of an audio signal uses the audio signal spectrum information estimation apparatus 200 shown in FIG. 2.

Referring to FIG. 16, the audio signal spectrum information estimation method according to an embodiment of the present invention further includes step 1602 of determining an order of a peak spectrum in addition to the audio signal spectrum information estimation method shown in FIG. 4.

Meanwhile, steps 401 through 410 of FIG. 4 may be the same as steps 1601 and 1603 through 1612 of FIG. 16, and therefore, operations in the same steps will not be described. In step 1602, the estimation operation option determiner 600 determines an order of a peaks spectrum extracted by the high-order peak selector 207. According to another embodiment, the estimation operation option determiner 600 may determine in advance an order of a peaks spectrum extracted by the high-order peak selector 207 prior to step 1601.

In step 1605, the high-order peak selector 207 may extract peaks from a waveform of an audio signal which has been subjected to the morphological operation by the morphology filter 205, by using a peak extraction method, and extract a remainder signal region from the extracted peaks.

The high-order peak selector 207 may extract peaks sequentially from a $1^{st}$-order peak to an $N^{th}$ peak according to an order determined by the estimation operation option determiner 600.

The peak extraction method may include a hitting peak method, a mid-point method, and a pitch-based method, and is the same as a method for extracting a remainder signal region shown in FIG. 3.

Figure 17:
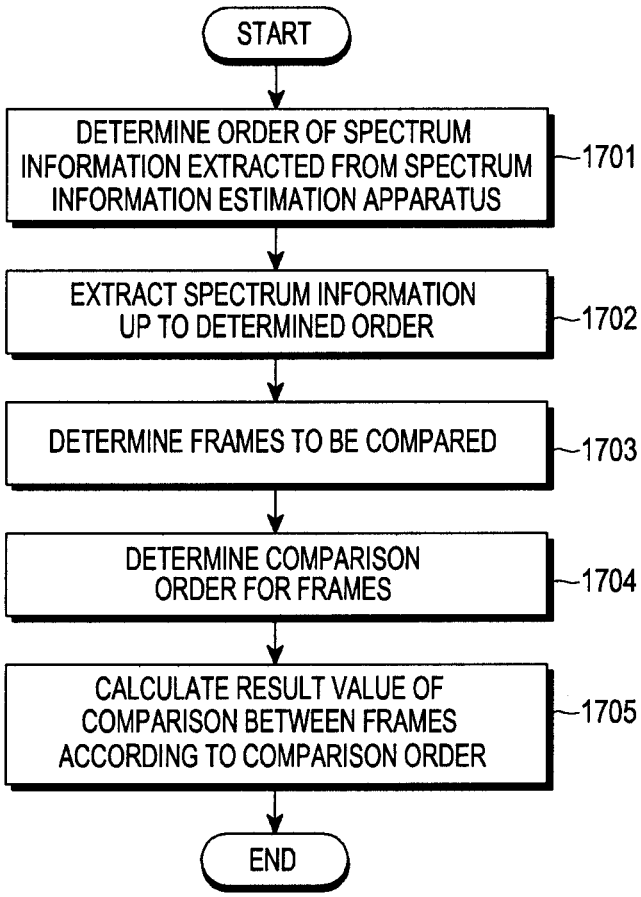
FIG. 17 is a flowchart of a method for comparing frames according to an exemplary embodiment of the present invention.

FIG. 17 is a flowchart of a method for comparing frames according to an exemplary embodiment of the present invention.

Referring to FIG. 17, in step 1701, the estimation operation option determiner 600 determines an order of spectrum information extracted from the spectrum information estimation apparatus 200. Once the order of the spectrum information is determined, the spectrum information estimation apparatus 200 extracts spectrum information up to the determined order in step 1702. According to an exemplary embodiment of the present invention, the spectrum information estimation apparatus 200 stores the spectrum information extracted in step 1702 or outputs the extracted spectrum information to the frame comparator 700.

In step 1703, the comparison frame determination unit 710 of the frame comparator 700 determines frames to be compared. In step 1704, the frame comparison option determiner 800 determines a comparison order.

According to another embodiment of the present invention, prior to step 1703, the comparison frame determination unit 710 may determine frames to be compared. Similarly, the frame comparison option determiner 800 may determine a comparison order prior to step 1704. Sequential orders of operations of steps 1703 and 1704 may also be exchanged.

Once the comparison order is determined, the frame comparison unit 720 of the frame comparator 700 calculates a result value of frame comparison based on the determined comparison order in step 1705. When the current frame and a comparison target frame are compared in step 1705, the frame comparison unit 720 calculates a comparison result value by comparing only spectrum information up to the comparison order determined in step 1704. For example, if the comparison order determined by the frame comparison option determiner 800 in step 1704 is a $3^{rd}$ order, the $1^{st}$-order comparison unit 720-1, the $2^{nd}$-order comparison unit 720-2, and the $3^{rd}$-order comparison unit 730-1 may perform operations of step 1705. Other effects of the present invention will cover a wider range that can be construed not only from the contents described in the aforementioned embodiments and the appended claims of the present invention, but also by the effects which can be generated within a range easily inducible therefrom, and by the probabilities of potential advantages that contribute to the industrial development.

While the invention has been shown and described with reference to specific exemplary embodiments thereof, it will be understood by those skilled in the art that various changes and modifications in form and details may be made therein without departing from the spirit and scope of the invention as defined by the appended claims and equivalents thereto.

What is claimed is:

1. A frame comparison apparatus for comparing frames included in an audio signal, the frame comparison apparatus comprising:

a spectrum information estimation apparatus to estimate spectrum information in at least one frames included in the audio signal;

an estimation operation option determiner to determine an order of a peaks spectrum in the spectrum information output by the spectrum information estimation apparatus;

a frame comparison option determiner to determine characteristics of frames output by the spectrum information estimation apparatus; and a frame comparator for to compare the determined characteristics of each frame output by the spectrum information estimation apparatus to a comparison target frame.

2. The frame comparison apparatus of claim 1, wherein the spectrum information estimated by the spectrum information estimation apparatus are frequencies of peaks included in the audio signal transformed into a frequency domain.

3. The frame comparison apparatus of claim 1, wherein the spectrum information estimation apparatus estimates the spectrum information based on the order determined by the estimation operation option determiner.

4. The frame comparison apparatus of claim 3, wherein the estimation operation option determiner determines the order based on a signal-to-noise ratio (SNR) of the audio signal.

5. The frame comparison apparatus of claim 1, wherein the frame comparison option determiner determines a comparison order based on a signal-to-noise ratio (SNR) of the audio signal.

6. The frame comparison apparatus of claim 1, wherein the spectrum information estimation apparatus comprises:

an audio signal input unit for receiving the audio signal;

a frequency-domain transformer for transforming the audio signal into a frequency domain; and a high-order peak selector for extracting peaks from the audio signal transformed into the frequency domain by using a peak extraction method.

7. The frame comparison apparatus of claim 6, wherein the high-order peak selector extracts peaks up to the order determined by the estimation operation option determiner.

8. The frame comparison apparatus of claim 6, wherein the frame comparator calculates at least one of an average, a standard deviation, and a gradient of the peaks extracted for each frame and the comparison target frame and compares the frames by using a calculated value.

9. A frame comparison method of a frame comparison apparatus for comparing frames included in an audio signal by using spectrum information, the frame comparison method comprising:

determining an order of a peaks spectrum in spectrum information estimated for an input audio signal;

estimating spectrum information for frames included in a received audio signal based on the determined order;

determining characteristics of the frames included in the audio signal;

identifying a comparison target frame;

comparing the determined characteristics of at least one frame in the audio signal to the comparison target frame; and generating a comparison result value.

10. The frame comparison method of claim 9, wherein the estimated spectrum information are frequencies of peaks included in the audio signal transformed into the frequency domain.

11. The frame comparison method of claim 9, wherein the order is determined based on at least one of a signal-to-noise ratio (SNR) of the audio signal and a noise level of the audio signal.

12. The frame comparison method of claim 11, wherein estimating the spectrum information comprises:

receiving the audio signal;

transforming the received audio signal into the frequency domain; and extracting peaks included in the audio signal transformed into the frequency domain.

13. The frame comparison method of claim 12, wherein extracting the peaks comprises repeating extraction of peaks until peaks are extracted up to the order.

14. The frame comparison method of claim 9, wherein a number of comparison frames is determined based on at least one of a signal-to-noise ratio (SNR) of the audio signal and a noise level of the audio signal.

15. The frame comparison method of claim 9, wherein generating the comparison result value comprises calculating at least one of an average, a standard deviation, and a gradient of the peaks extracted for each frame and the comparison target frame and comparing the frames by using a calculated value.

* * * * *

UNITED STATES PATENT AND TRADEMARK OFFICE

CERTIFICATE OF CORRECTION

PATENT NO. : 8,935,158 B2
APPLICATION NO. : 13/558606
DATED : January 13, 2015
INVENTOR(S) : Hyun-Soo Kim It is certified that error appears in the above-identified patent and that said Letters Patent is hereby corrected as shown below:

In the claims,

Column 19, Claim 1, Line 66 should read as follows:
--...least one frame included...--

Column 20, Claim 1, Line 8 should read as follows:
--...a frame comparator to...--

Signed and Sealed this
Twenty-eighth Day of April, 2015

Michelle K. Lee

Michelle K. Lee
*Director of the United States Patent and Trademark Office*